US009531140B2

(12) United States Patent
Kauffman

(10) Patent No.: US 9,531,140 B2
(45) Date of Patent: Dec. 27, 2016

(54) COAXIAL PROTECTIVE DEVICE

(71) Applicant: George M. Kauffman, Hudson, MA (US)

(72) Inventor: George M. Kauffman, Hudson, MA (US)

( * ) Notice: Subject to any disclaimer, the term of this patent is extended or adjusted under 35 U.S.C. 154(b) by 365 days.

(21) Appl. No.: 14/134,583

(22) Filed: Dec. 19, 2013

(65) Prior Publication Data

US 2014/0177122 A1 Jun. 26, 2014

Related U.S. Application Data

(60) Provisional application No. 61/745,257, filed on Dec. 21, 2012, provisional application No. 61/774,449, filed on Mar. 7, 2013.

(51) Int. Cl.

| | |
|---|---|
| ***H01C 7/12*** | (2006.01) |
| ***H02H 1/00*** | (2006.01) |
| ***H02H 1/04*** | (2006.01) |
| ***H02H 3/22*** | (2006.01) |
| ***H01R 24/48*** | (2011.01) |
| *H01R 103/00* | (2006.01) |
| *H01R 24/44* | (2011.01) |

(52) U.S. Cl.

CPC ..... *H01R 24/48* (2013.01); *H01R 24/44* (2013.01); *H01R 2103/00* (2013.01)

(58) Field of Classification Search

CPC ..... H02H 9/04; H01T 4/08; H01R 24/48
USPC ..... 361/119
See application file for complete search history.

(56) References Cited

U.S. PATENT DOCUMENTS

| | | | | |
|---|---|---|---|---|
| 6,754,060 | B2 | 6/2004 | Kauffman | |
| 7,609,502 | B2 | 10/2009 | Kauffman | |
| 7,841,866 | B2 | 11/2010 | Hsu | |
| 7,878,867 | B2 | 2/2011 | Lin | |
| 8,172,591 | B2 | 5/2012 | Wertz | |
| 8,228,656 | B2 | 7/2012 | Kauffman | |
| 8,488,290 | B2 | 7/2013 | Kauffman | |
| 2002/0021541 | A1* | 2/2002 | Kauffman | H01Q 1/50 361/119 |
| 2002/0111057 | A1 | 8/2002 | Bernat | |
| 2012/0000706 | A1 | 1/2012 | Kauffman | |

* cited by examiner

*Primary Examiner* — Dharti Patel
(74) *Attorney, Agent, or Firm* — Kriegsman & Kriegsman

(57) ABSTRACT

A protective device for transmitting electromagnetic signals includes an inner conductor that extends coaxially within an outer conductor. To compensate for dimensional tolerances without compromising performance, inner conductor is constructed to include a center pin with a conical end, a plunger pin slidably disposed within an axial bore in the center pin, the plunger pin including a conical end located outside the center pin, and a resilient, expandable, conductive band coaxially mounted onto the conical ends of the center and plunger pins. A gas discharge tube is conductively coupled between the inner and outer conductors to discharge transient voltages transmitted along the inner conductor. To minimize disturbance to the transmission line, the width of the gas discharge tube in the region of contact with the inner conductor is preferably equal to the diameter of the inner conductor. Additionally, the gas discharge tube is preferably greater in length than in width.

22 Claims, 6 Drawing Sheets

COAXIAL PROTECTIVE DEVICE

FIELD OF THE INVENTION

The present invention relates generally to devices for transmitting electromagnetic signals of a desired frequency range and, more particularly, to devices for transmitting electromagnetic signals of a desired frequency range that additionally provide over-voltage protection to the transmission line.

BACKGROUND OF THE INVENTION

A radio frequency (RF) transmission line is a structure that is designed to efficiently transmit high frequency, radio frequency (RF) signals. An RF transmission line typically comprises two conductors, such as a pair of metal wires, which are separated by an insulating material with dielectric properties, such as a polymer or air. One type of an RF transmission line which is well known in the art is a coaxial electric device.

Coaxial electric devices, such as coaxial cables, coaxial connectors and coaxial switches, are well known in the art and are widely used to transmit electromagnetic signals over 10 MHz with minimum loss and limited distortion. As a result, coaxial electric devices are commonly used to transmit and receive signals used in telecommunications, broadcast, military, security and civilian transceiver applications, as well as numerous additional uses.

A coaxial electric device typically comprises an inner signal conductor which serves to transmit the desired frequency communication signal between a source and a load. The inner signal conductor is separated from an outer conductor by an insulating material, or dielectric material, the outer conductor serving as the return path, or ground, for the communication signal. Such an electric device is typically referred to as coaxial because the inner and outer conductors share a common longitudinal axis. It should be noted that the relationship of the geometry of the conductors and the properties of the dielectric materials disposed between the conductors substantially define the characteristic impedance of the coaxial device.

It has been found that, on occasion, potentially harmful voltages are transmitted through RF transmission lines. In particular, radios operating in either the lower end of the ultra high frequency (UHF) band or lower frequency bands (i.e., below 500 MHz) often utilize longer antenna lengths to enhance performance when compared to antennae used in higher frequency applications. Furthermore, since the mounting height of a radio antenna serves to increase its range, radio antennae are commonly mounted from an elevated position (e.g., a tower or mast). As a result, it has been found that radio antennae are highly susceptible to lightning strikes, the high electrical energy of a lightning strike increasing the likelihood of significant damage to any sensitive components and circuits connected to the transmission line.

A coaxial protective device, or coaxial protector, is commonly incorporated into an RF transmission line in order to suppress or otherwise deflect undesirable electromagnetic impulses away from a load connected thereto. Coaxial protectors are typically designed to include one or more protective components in order to treat undesirable electromagnetic signals.

For instance, one type of coaxial protective device which is well-known in the art conductively couples at least one voltage suppression component, such as a gas discharge tube, between the inner signal conductor and the grounded outer conductor. Accordingly, excessive voltage (e.g., as a result of a lightning strike) transmitted along the inner conductor is diverted from the inner conductor and treated by the voltage suppression device, thereby protecting sensitive equipment connected to the transmission line.

Although well-known and widely used in the art, coaxial protective devices of the type described above, which dispose at least one voltage suppression component between the inner and outer conductors, often introduce disturbance to the transmission line. In particular, gas discharge tubes used in coaxial protective devices are traditionally large in size, with a relatively wide diameter in transverse cross-section (approximately 8 mm) and a comparatively shorter length (approximately 6 mm). Because the inner conductor is formed using a conductive pin of limited diameter (approximately 3 mm) to minimize the overall size of the protector, the pin is often effectively widened to a considerable degree in diameter (approximately 8 mm) in the region of contact with the gas discharge tubes as a result of the end electrode dimensions of the gas discharge tubes or to ensure that an adequate conductive path is established. Due to both the considerable widening of inner conductor pin (often by a factor of 2 or more) as well as the inherent capacitance of the one or more gas discharge tubes, disturbance is imparted onto the transmission line, which is highly undesirable. Although certain attempts have been made in the art to reduce transmission line disturbance caused from the inclusion of voltage suppression devices, most solutions result in either a substantial increase in the overall size of the protective device and/or suffer a reduction in the upper operational frequency.

Another type of coaxial protective device which is well-known in the art incorporates a signal treatment component (e.g., a capacitor, resistor, inductor, fuse or semiconductor) directly into the inner conductor. For instance, the inner conductor may include multiple conductive elements (including the signal treatment component), which are joined end-to-end, typically using a compressive force, to form a unitary, linear, conductive member.

Although well-known and widely used in the art, coaxial protective devices of the type described above, which incorporate a signal treatment component directly into the inner conductor, often require use of a resilient member, such as a coil spring, to compensate for variances in inner conductor geometry that result from, inter alia, tolerances in manufacturing as well as certain environmental conditions (e.g., changes in temperature). However, the use of a coil spring in the assembly of the inner conductor has been found to be undesirable due to the self-inductance of the coil. In addition, a coil spring typically establishes an area of contact with adjacent components that is significantly narrower than the remaining center pin diameter. This dimensional reduction in the current path along the inner conductor creates a variance in impedance along the RF transmission line, which is highly undesirable.

Another type of coaxial protective device which is well-known in the art includes a shunt conductor that connects the center conductor to ground. A quarter-wave stub or an inductor is typically utilized as the shunt conductor in this type of protective device. Although widely used in the art, this type of coaxial protector has been found to suffer from certain limitations. Specifically, the protector has been found to provide either a limited operational frequency of over 400 MHz when a quarter-wave stub is utilized or a narrow banded performance when an inductor is utilized. In addition, due to the relatively high impedance and physically longer length of the shunt conductor, the protective device affords poor protection in the lower frequency range.

BRIEF SUMMARY OF THE INVENTION

It is an object of the present invention to provide a new and improved device for transmitting electromagnetic signals of a desired frequency band from a source to a load.

It is another object of the present invention to provide a device as described above which is provided with at least one protective component for suppressing transient, high voltage signals received from the source.

It is yet another object of the present invention to provide a device as described above that reduces or substantially eliminates disturbance to the transmission line created from the at least one protective component.

It is still another object of the present invention to provide a device as described above that is relatively compact in overall size.

It is yet still another object of the present invention to provide a device as described above that allows for an extended range of frequency operation.

It is another object of the present invention to provide a device as described above that imparts limited variance to the impedance of the RF transmission line.

It is yet another object of the present invention to provide a device as described above that has a limited number of parts, is inexpensive to manufacture and easy to use.

Accordingly, as a principal feature of the present invention, there is provided a protective device for transmitting electromagnetic signals of a desired frequency band, the protective device comprising (a) an outer conductor, (b) an inner conductor extending within the outer conductor, the inner and outer conductors being spaced apart and electrically insulated from one another, the inner conductor having a contact portion with a diameter, and (c) an electrical component comprising first and second opposing contact terminals, the first contact terminal directly contacting the contact portion of the inner conductor, the second contact terminal being conductively coupled to the outer conductor, (d) wherein the first contact terminal for the electrical component has a width that is approximately equal to the diameter of the contact portion of the inner conductor.

As another feature of the present invention, there is provided protective device for transmitting electromagnetic signals of a desired frequency band, the protective device comprising (a) an outer conductor, and (b) an inner conductor extending within the outer conductor, the inner and outer conductors being spaced apart and electrically insulated from one another, the inner conductor comprising, (i) a first conductive pin having a first end and a second end, the second end of the first conducive pin including a tapered surface, (ii) a second conducive pin disposed in coaxial alignment with and the first conductive pin, the second conductive pin adapted for movement relative to the first conductive pin, the second conductive pin having a first end and a second end, the second end of the second conductive pin including a tapered surface, and (iii) a resilient conductive band disposed coaxially around the tapered surfaces of the first and second conductive pins and in direct contact therewith.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE INVENTION

Figure 1:
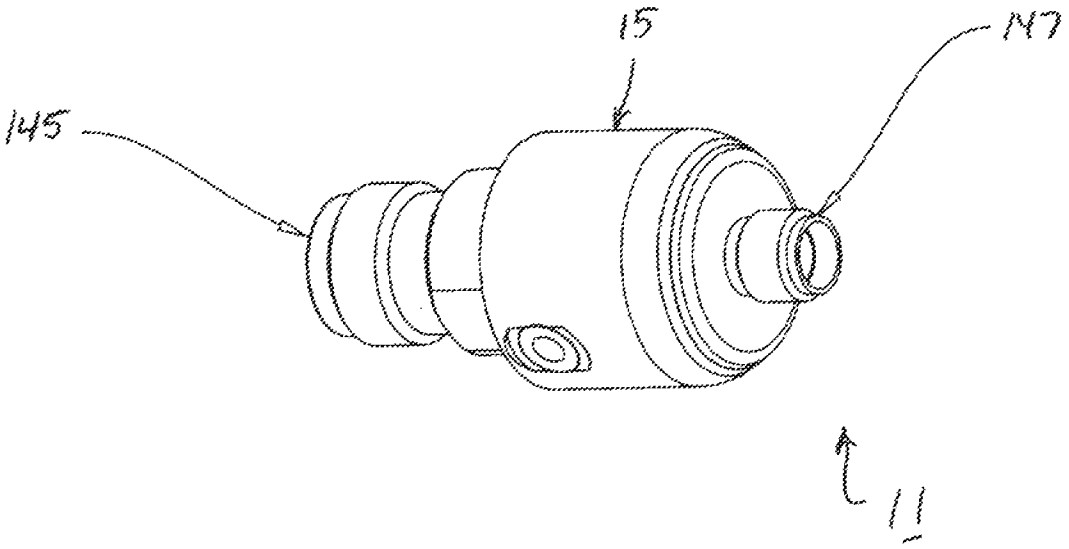
FIG. 1 is a front perspective view of a coaxial protective device constructed according to the teachings of the present invention.
Figure 2:
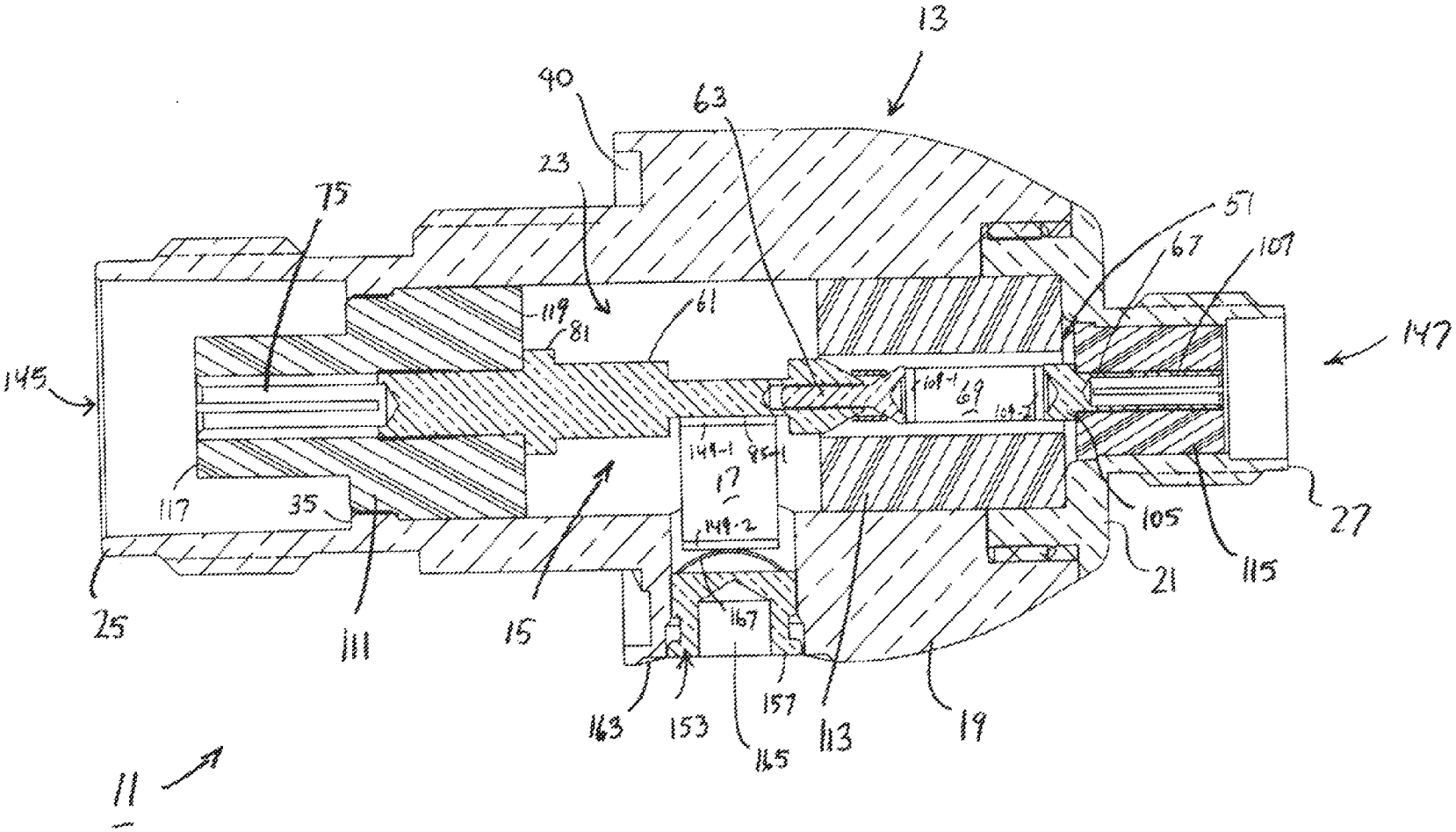
FIG. 2 is a longitudinal section view of the coaxial protective device shown in FIG. 1.
Figure 3:
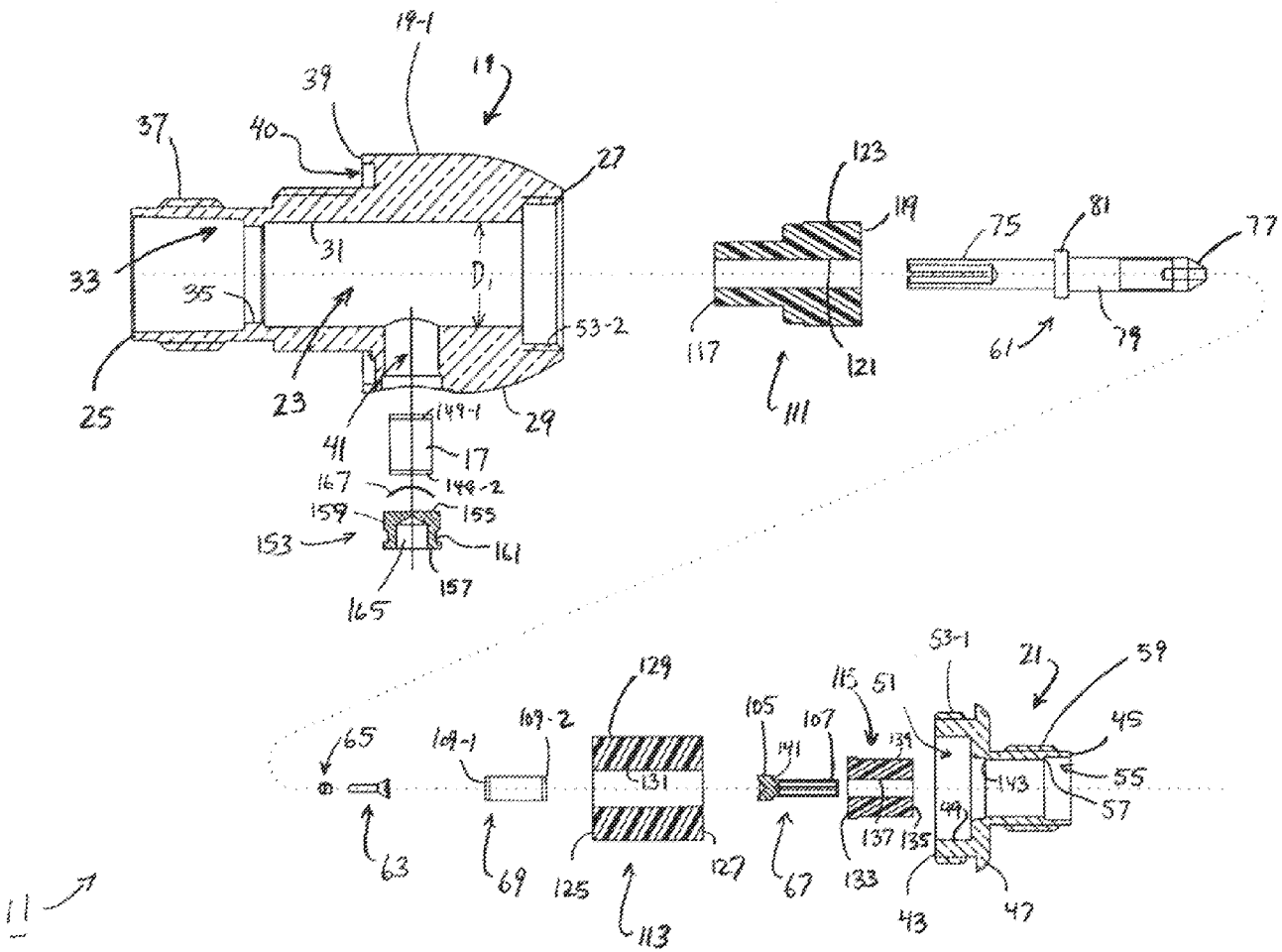
FIG. 3 is an exploded section view of the coaxial protective device shown in FIG. 2.

Referring now to FIGS. 1-3, there is shown a coaxial protective device constructed according to the teachings of the present invention, the coaxial protective device being identified generally by reference numeral 11. In use, coaxial protective device 11 protects sensitive electrical components from excessive voltage transmitted along a transmission line (e.g., as a result of a lightning strike), as will be described further in detail below.

Protective device, or protector, 11 transmits electromagnetic signals of a desired frequency band between a source and a load and comprises an outer conductor 13, an inner conductor 15 extending coaxially within outer conductor 13 in a spaced apart relationship relative thereto, and a voltage suppression component 17 extending between inner conductor 15 and outer conductor 13 for discharging potentially harmful transient voltages transmitted along inner conductor 15. As will be explained in detail below, the particular construction of inner conductor 15 as well as the unique dimensional configuration of voltage suppression component 17 (particularly, in relation to inner conductor 15) serve as principle novel features of the present invention.

Outer conductor 13 serves as the return path, or ground, for the communication signal. Preferably, outer conductor 13 is forged, machined or otherwise constructed from one or more pieces of rigid, durable and highly conductive material, such as brass or a copper alloy with a suitable conductive finish. In the present embodiment, outer conductor 13 is shown comprising a main housing 19 and a cover, or end plug, 21 that are coaxially jointed together in an end-to-end relationship.

As seen most clearly in FIG. 3, main housing 19 is an enlarged, generally tubular member that is shaped to define a partially enclosed, longitudinally extending, central cavity 23 with a generally uniform diameter $D_1$ in transverse cross-section along the majority of its length. Main housing 19 includes an open first end 25, an open second end 27, an outer surface 29 and an inner surface 31.

It should be noted that the main housing 19 is provided with a tapered counterbore 33 at first end 25. As a result, an inwardly protruding annular ridge 35 is formed in inner surface 31 proximate first end 25 that serves, inter alia, (i) as a contact surface for a mating connector (not shown) as well as (ii) an abutment surface to retain protector 11 in its assembled state, as will be explained further below.

To facilitate connection to another transmission line component, external threads 37 are provided on outer surface 29 at first end 25. Additionally, outer surface 29 is preferably shaped to define an outwardly or radially extending, annular flange, or face, 39 in a widened portion 19-1 of housing 19. As can be appreciated, annular flange 39 facilitates mounting of protector 11 within a through hole formed in a bulkhead (not shown), as is common in the industry, flange 39 being shaped to include an annular groove 40 for receiving an O-ring (not shown) to seal the penetration of the bulkhead.

A transverse bore, or port, 41 is formed in main housing 19 that extends in communication with central cavity 23 in an orthogonal relationship relative thereto. As will be described further below, bore 41 is appropriately dimensioned to receive voltage suppression component 17 as well as certain related items for retaining voltage suppression component 17 in place.

As seen most clearly in FIGS. 2 and 3, cover 21 is a generally hollow, cylindrical, plug-like member that is joined to main housing 19 in a coaxial, end-to-end relationship. Cover 21 is a unitary member constructed of a rigid and durable conductive material that is shaped to include an open first end 43, an open second end 45, an outer surface 47 and an inner surface 49 that together define a longitudinally extending central cavity 51 that extends in coaxial communication with cavity 23.

First end 43 of cover 21 is designed to fit within counterbored second end 27 of main housing 19. In the present embodiment, outer surface 47 of cover 21 at first end 43 and inner surface 31 of main housing 19 at second end 27 are provided with complementary threads 53-1 and 53-2, respectively. In this manner, cover 21 can be easily and reliably secured onto main housing 19. However, it is to be understood that alternative means for coupling cover 21 to main housing 19 could be utilized (e.g., through a press fit relationship) without departing from the spirit of the present invention.

To assist in tightening cover 21 onto main housing 19, cover 21 may be provided with externally accessible spanner holes (not shown) in outer surface 47. Thus, by inserting a spanner wrench, or other similar instrument, into the corresponding spanner holes, the wrench can then be used to rotate cover 21 into tight threaded engagement with housing 19. Although not shown herein, a gasket or other similar item may be disposed between cover 21 and housing 19 to provide an adequate, watertight seal between components.

Cover 21 is provided with a counterbore 55 at second end 45. As a result, an inwardly protruding annular ridge 57 is formed in inner surface 49 proximate second end 45 that serves, inter alia, as a contact surface for engagement by a retention ring for a mating connector (not shown). To further facilitate connection to the mating connector, external threads 59 are provided on outer surface 47 at second end 45.

As seen most clearly in FIGS. 2 and 3, inner conductor 15 extends longitudinally within central cavities 23 and 51 in both a conductively isolated and coaxial relationship relative to outer conductor 13. In use, inner conductor 15 serves to transmit the desired communication signal for device 11.

Inner conductor 15 is constructed from a plurality of individual, conductive components that are assembled together end-to-end in a generally coaxial relationship. As will be described further below, inner conductor 15 is specifically designed with selected components that are constructed and joined in such a fashion so at to provide adequate compensation for manufacturing and environmental tolerances without compromising transmission line performance and, as such, serves as a principal novel feature of the present invention.

Inner conductor 15 comprises a center pin 61, a plunger pin 63, a resilient band 65, a contact pin 67 and a voltage treatment component 69 that are joined end-to-end in coaxial relationship and maintained as such using a suitable compressive force.

Figure 4:
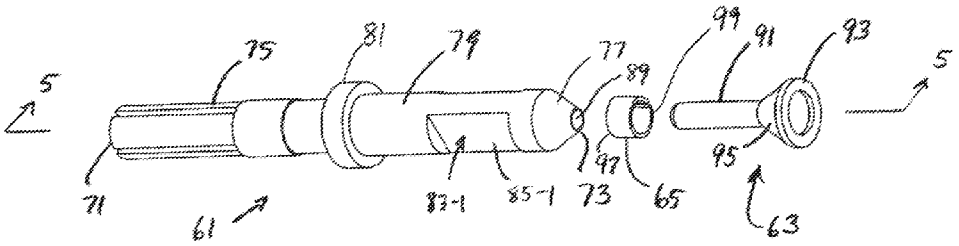
FIG. 4 is an enlarged, exploded, front perspective view of the center pin, plunger pin and spring band shown in FIG. 3.
Figure 5:
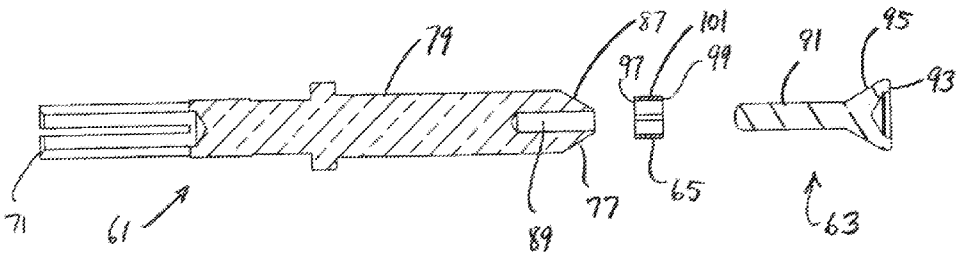
FIG. 5 is an exploded, section view of the center pin, plunger pin and spring band shown in FIG. 4, taken along lines 5-5.
Figure 6:
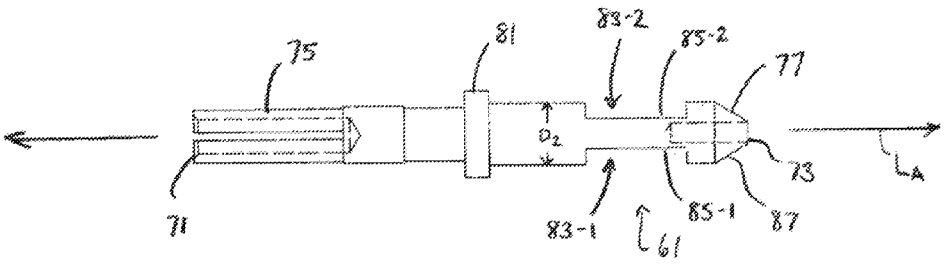
FIG. 6 is a top view of the center pin shown in FIG. 4.

As seen most clearly in FIGS. 4-6, center pin 61 is an elongated, unitary, generally solid cylindrical member that is preferably constructed of a highly conductive material that is suitable for transmitting electrical signals, such as a copper alloy or brass plated in gold or silver. Center pin 61 comprises a first end 71, a second end 73, a connector portion 75 formed at first end 71, a tapered portion 77 formed at second end 73, and a contact portion 79 disposed between connector portion 75 and tapered portion 77.

Center pin 61 is additionally shaped to include an outward projecting, widened, annular collar 81 between connector portion 75 and contact portion 79. As will be explained further below, collar 81 serves as an abutment surface that is utilized to help maintain coaxial protector 11 in its assembled state.

Connector portion 75 of center pin 61 is represented herein as terminating into a female, TNC-type socket connector at first end 71. As such, connector portion 75 is appropriately configured to conductively receive a corresponding pin on a mating, male-type connector (not shown).

Contact portion 79 of center pin 61 has a generally tubular shape with a constant diameter $D_2$ along its length. As seen most clearly in FIGS. 4 and 6, contact portion 79 is preferably provided with a pair of opposing cutouts 83-1 and 83-2 which define corresponding flattened surfaces 85-1 and 85-2, respectively. As will be explained further below, each flattened surface 85 serves as an enlarged, planar contact surface against which a corresponding voltage suppression component 17 can be disposed, thereby ensuring optimal electrical contact is maintained between inner conductor 15 and each voltage suppression component 17. It should be noted that, although inner conductor 15 is designed to conductively receive a pair of voltage suppression components 17, a single voltage suppression component 17 is represented in the figures for simplicity purposes only.

As defined herein, diameter $D_2$ is measured across contact portion 79 along a line that represents the maximum measurable width of contact portion 79. In other words, in the present embodiment, diameter $D_1$ is measured along a line that is offset from, or taken outside, of cutouts 83, since the width of contact portion 79 is significantly less when measured directly through cutouts 83, as seen most clearly in FIG. 6.

Furthermore, it is to be understood that diameter $D_2$ is not limited to a contact portion 79 that is generally circular in transverse cross-section but rather could be similarly used to define a corresponding cross-sectional dimensional aspect of alternatively shaped contact portions. For instance, in the case of a center pin that is generally rectangular or square-shape in transverse cross-section, an equivalent dimension may be calculated by averaging the cross-sectional height and width of such a pin within its contact portion.

Tapered portion 77 of center pin 61 includes a relatively smooth, gradually narrowing tapered outer surface 87 towards second end 73. As such, tapered portion 77 is provided with an overall shape in the form of a conical frustum. For reasons to become apparent below, the optimum included angle of tapered surface 87 is preferably in the range of approximately 50-80 degrees.

As seen clearly in FIGS. 4 and 5, a longitudinal bore 89 is formed into second end 73. As will be described further below, bore 89 is generally circular cross-section and is dimensioned to axially receive plunger pin 63.

Referring now to FIGS. 4 and 5, plunger pin 63 is a unitary member that is preferably constructed of a highly conductive material suitable for transmitting electrical signals. Plunger pin 63 comprises an elongated, straightened, generally cylindrical stem 91 and a widened cup 93 in the shape of a conical frustum. As can be seen, widened cup 93 includes a tapered outer surface 95. Tapered outer surface 95 is preferably smooth and has an included angle preferably in the range of approximately 50-80 degrees.

Stem 91 of plunger pin 63 is dimensioned for axial insertion into bore 89 in center pin 61. In this manner, plunger pin 63 is capable of moving along a linear and slightly radial path relative to center pin 61, with tapered surface 87 on center pin 61 and tapered surface 95 on plunger pin 63 facing one another as near mirror images.

Figure 7:
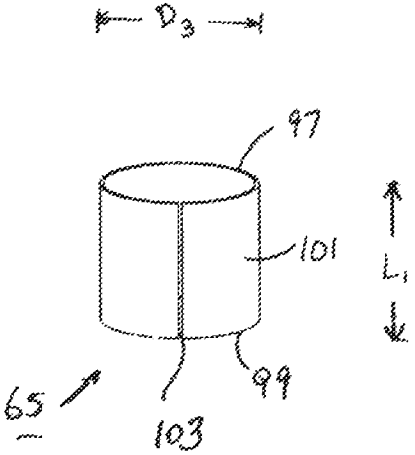
FIG. 7 is an enlarged, rear perspective view of the spring band shown in FIG. 4.

As seen most clearly in FIG. 7, resilient, or spring, band 65 is constructed as a unitary, shortened cylinder formed of a highly conductive and resilient material, such a beryllium copper alloy coated with a low friction, tin finish. Band 65 is preferably of a limited length (e.g., a length $L_1$ that is approximately equal to its diameter $D_3$ and approximately one-half the diameter $D_2$ of center pin 61) and includes an open first end 97, an open second end 99 and a thin, continuous sidewall 101. Sidewall 101 is shaped to include a very narrow, longitudinal slit 103 to allow for slight radial expansion.

While the preferred implementation includes a continuous sidewall 101 with opposing free ends spaced slightly apart so as to define a narrow longitudinal slit 103, it is to be understood that band 65 could be alternatively constructed such that the opposing free ends of sidewall 101 overlap each other. In this manner, the resultant band is still capable of radial expansion.

Figure 8A:
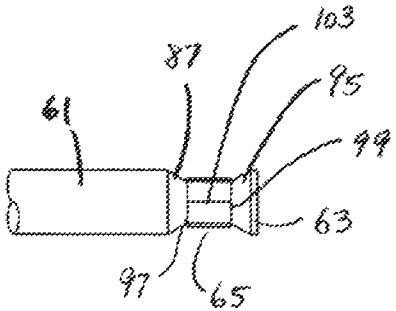
FIGS. 8(*a*) and 8(*b*) are fragmentary, rear views of the center pin, plunger pin and spring band shown in FIG. 2, the plunger pin being shown at extended and retracted positions, respectively, relative to the center pin.
Figure 8B:
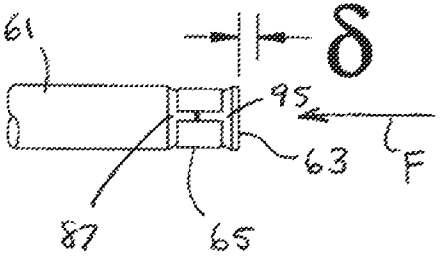

Referring now to FIGS. 8(*a*) and 8(*b*), resilient band 65 is axially mounted over tapered surface 87 on center pin 61 as well as tapered surface 95 on plunger pin 99, with first end 97 of band 65 disposed in direct circumferential, or near circumferential, contact against tapered surface 87 and second end 99 disposed in direct circumferential, or near circumferential, contact against tapered surface 95. Disposed as such, resilient band 65 naturally centers itself between tapered surface 87 and 95.

In use, band 65 allows for axial and slight radial movement of plunger pin 99 relative to center pin 61 while maintaining a relatively constant circumferential conductive path therebetween. As a result, inner conductor 15 is designed to maintain a constant impedance for the RF transmission line, which is a principal object of the present invention.

Specifically, as seen most clearly in FIG. 8(*a*), spring band 65 is naturally biased so as to urge, or separate, tapered surface 95 of plunger pin 63 slightly apart from tapered surface 87 of center pin 61, with band 65 establishing a circumferential conductive path between plunger pin 63 and center pin 61 that is generally equal to diameter $D_2$ of center pin 61. As seen in FIG. 8(*b*), plunger pin 63 is additionally capable of axial, as well as limited radial, movement relative to center pin 61 upon application of a compressive force F, with resilient band 65 straddling opposing tapered surfaces 87 and 95 and expanding to the extent necessary to accommodate such movement. In this manner, plunger pin 63 is capable of inward axial displacement within bore 89 a deflection distance δ that is preferably one-third of center pin diameter $D_2$ (or, more generally, in the range of 25% to 50% of center pin diameter $D_2$). As a consequence, inner conductor 15 is able to compensate for manufacturing and environmental tolerances without significantly affecting transmission line impedance, as will be described further below. Upon release of compressive force F, resilient band 65 contracts to its natural configuration, the contraction of band 65 applying an angular force on tapered surfaces 87 and 95 that results in the separation of plunger pin 63 from center pin 61 to its original rest position, as shown in FIG. 8(*a*).

The aforementioned interrelationship between center pin 61, plunger pin 63 and resilient band 65 provides inner conductor 15 with a number of significant advantages.

As a first advantage, the use of resilient band 65 to maintain a circumferential, or near circumferential, conductive path between the pair of separable conductive pins 61 and 63 is significant in that the diameter of the conductive path remains largely consistent as the pair of conductive pins 61 and 63 move towards or apart from one another. As a result, inner conductor 15 retains a generally constant conductive path geometry which, in turn, minimizes changes to the RF transmission line impedance.

It should be noted that, even though the expansion of band 65 serves to increase its diameter, the gap, or spacing, in slit 103 increases in a proportional factor. As a result, although the increase in the diameter of band 65 tends to lower the impedance of the transmission line within the region of band 65, the proportional increase in the spacing in slit 103 serves to increase the impedance of the transmission line within the region of band 65 in a complementary fashion. Therefore, impedance change caused by the variance in the diameter of band 65 is counteracted by impedance changed caused by the corresponding variance in the spacing of slit 103. In this manner, the effect that band 65 has on the impedance of the transmission line is self-compensating, to an extent, throughout variations in pin 63 deflection.

As a second advantage, the use of a pair of opposing conically-shaped pins 61 and 63 (instead of a single, conically-shaped pin) effectively doubles the deflection distance δ that can be obtained by inner conductor 15 without significantly modifying the conductive path geometry.

As a third advantage, the geometric interrelationship between resilient band 65 and tapered surfaces 87 and 95 allows for slight radial deflection of plunger pin 63 relative to center pin 61 (i.e., at an angle relative to the longitudinal axis $L_A$ of center conductor 15), thereby providing further compensation for manufacturing and environmental tolerances.

Referring back to FIGS. 2 and 3, contact pin 67 is an elongated, unitary member that is preferably constructed of a highly conductive material that is suitable for transmitting electrical signals. Contact pin 67 includes a first end 105 in the form of an enlarged head and a second end 107 that is represented herein as a female, SMA-type socket connector.

Voltage treatment component 69 is axially disposed in series between plunger pin 63 and contact pin 67 and retained in constant conductive contact through the application of a continuous compressive force, as will be explained further below. In the present embodiment, component 69 is represented as a generally block-shaped capacitor with opposing contact terminals, or metalized electrodes, 109-1 and 109-2 formed at its ends, with terminal 109-1 disposed in direct contact against cup 93 on plunger pin 63 and opposite terminal 109-2 disposed in direct contact against first end 105 of contact pin 67. In use, component 69 can function as a device for filtering signals transmitted along inner conductor 15.

It should be noted that component 69 is not limited to being in the form a capacitor. Rather, it is to be understood that component represents any conductive component that can be used to selectively treat the transmission signal. For instance, component 69 could be alternatively in the form of, inter alia, a resistor, an inductor, a fuse, a semiconductor or a printed circuit board (PCB) contact without departing from the spirit of the present invention.

First, second and third insulators 111, 113 and 115, respectively, are mounted on inner conductor 15 and together serve, inter alia, (i) to electrically insulate inner conductor 15 from outer conductor 13, (ii) to help establish a constant RF transmission line impedance and (iii) to maintain inner conductor 15 in its assembled state and in proper position within cavities 23 and 51.

First insulator 111 is a unitary, solid, generally annular, TNC-type dielectric sleeve that is mounted onto first end 71 of center pin 61. As seen in FIGS. 2 and 3, insulator includes a first end 117 that lies substantially flush with end 71 of connector portion 75, a second end 119 that firmly abuts against collar 81, an inner surface 121 that substantially conforms to the connector portion 75 of center pin 61, and an outer surface 123 that conforms to the shape of inner surface 31 of main housing 19 along a portion of its length so as to substantially enclose a region of cavity 23.

In the present embodiment, the portion of insulator 111 that is located within counterbore 33 is significantly reduced in outer diameter. As such, the aforementioned portion of insulator 111 sheathes connector portion 75 within counterbore 33. However, it is to be understood that the sheathed portion of insulator 111 could be eliminated (i.e., for connection with a different type of mating connector) without departing from the spirit of the present invention.

It should be noted that outer surface 123 of insulator 111 preferably has a stepped configuration so as to engage with the inwardly protruding annular ridge 35 formed on inner surface 31 of main housing 19. In this manner, with protector 11 in its assembled state, insulator 111 continuously applies an inward force against collar 81 on center pin 61 and, at the same time, engages ridge 35 to prevent displacement outward through first end 25. As a consequence, center pin 61 remains effectively stationary within cavity 23, thereby enabling plunger pin 63 to displace axially in relation to center pin 61, as referenced above.

Second, or center, insulator 113 is a unitary, solid, generally annular dielectric sleeve that surrounds tapered portion 77 of center pin 61, resilient band 65, plunger pin 63, component 69 and first end 105 of contact pin 67 in a spaced apart relationship relative thereto. As can be seen in FIGS. 2 and 3, insulator 113 includes an exposed first end 125, a second end 127 disposed firmly against inner surface 49 of cover 21, an outer surface 129 that substantially conforms to a portion of inner surfaces 31 and 49, and an inner surface 131 spaced slightly apart from the portion of inner conductor 15 in alignment therewith.

Third insulator 115 is a unitary, solid, generally annular, SMA-type dielectric sleeve that is directly mounted onto connector portion 107 of contact pin 67. As seen in FIGS. 2 and 3, third insulator 115 includes a widened first end 133, an exposed second end 135, an inner surface 137 that substantially conforms to connector portion 107 of contact pin 67 and an outer surface 139 that conforms to the shape of inner surface 49 of cover 21 immediately inside counterbore 55.

It should be noted that widened first end 133 of insulator 115 engages an outward flange, or ledge, 141 formed on base 105 of contact pin 67. Additionally, outer surface 139 of insulator 115 preferably has a stepped configuration at first end 133 that matingly engages a corresponding inward protrusion 143 formed on inner surface 49 of cover 21. In this manner, with protector 11 in its assembled state, third insulator 115 continuously applies an inward force onto base 105 of contact pin 67 and, at the same time, engages protrusion 143 on cover 21 to prevent displacement of inner conductor 15 out through open second end 45 of cover 21. Accordingly, first and third insulators 111 and 115 engage center pin 61 and contact pin 67, respectively, and apply a continuous compressive force that retains the various components of inner conductor 15 coaxially sandwiched into its assembled state. At the same time, first and third insulators 111 and 113 engage main housing 19 and cover 21, respectively, to counterbalance the inward compressive force applied onto inner conductor 15 and thereby prevent disassembly.

Together, first end 25 of main housing 19, insulator 111 and connector portion 75 of center pin 61 together define a first coaxial connector interface 145. Similarly, second end 45 of cover 21, insulator 115 and contact pin 67 together define a second coaxial connector interface 147.

In the present embodiment, first coaxial connector interface 145 is represented as an industry standard, female, TNC-type connector interface and second coaxial connector interface 147 is represented as an industry standard, female, SMA-type connector interface. However, it is to be understood that components of protector 11 could be modified, as needed, to provide either of first and second interfaces 145 and 147 with alternative means for attaching protector 11 to an electrical circuit. For instance, each of interfaces 145 and 147 could be modified with respect to its gender and/or attachment type (e.g., as a direct cable attachment or as a launcher to printed circuit board traces) without departing from the spirit of the present invention.

As referenced briefly above, voltage suppression component 17 is conductively coupled to inner conductor 15 and outer conductor 13 and, in use, serves to discharge potentially harmful transient voltages transmitted along inner conductor 15 while, at the same time, enabling signals within the desired voltage range to pass along inner conductor 15 unimpeded.

Figure 9:
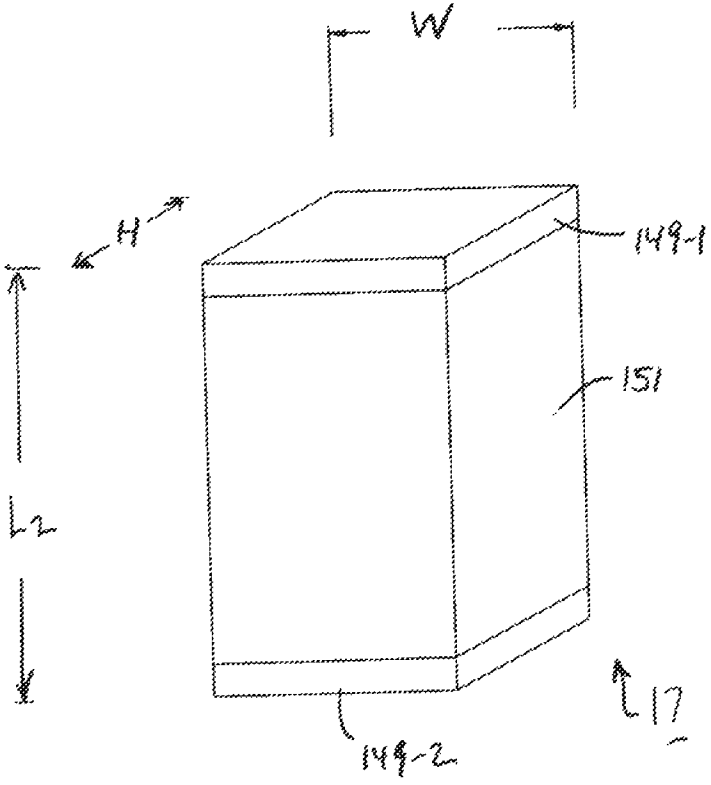
FIG. 9 is an enlarged, front perspective view of the voltage suppression component shown in FIG. 2.

As seen most clearly in FIG. 9, voltage suppression component 17 has a block-shaped construction that is uniformly rectangular in transverse cross-section along the entirety of its length. Component 17 includes first and second, flattened contact electrodes, or terminals, 149-1 and 149-2 separated by an elongated, central insulator 151 constructed preferably of a suitable dielectric material, such as a ceramic or glass material. Together, terminals 149 and insulator 151 provide component 17 with a substantial overall length $L_2$ (i.e., from exposed surface of electrode 149-1 to exposed surface of electrode 149-2), a constant width W and a constant height H. As will be described further in detail below, the particular dimensions of component 17, especially in relation to center pin 61 of inner conductor 15 as well as the inner diameter $D_1$ of interior cavity 23, minimizes the amount of disturbance imparted onto the RF transmission line by component 17.

Referring back to FIGS. 2 and 3, voltage suppression component 17 extends longitudinally through transverse bore 41 such that first terminal 149-1 is disposed in direct contact against flattened surface 85-1 on center pin 61. As such, component 17 extends in an orthogonal relationship relative to the longitudinal axis of inner conductor 15.

An externally accessible cap 153 is removably mounted within transverse bore 41 in main housing 19. In this capacity, cap 153 serves to substantially enclose transverse bore 41 at outer surface 29.

Cap 153 is preferably constructed as a unitary, generally solid, cylindrical plug formed out of a suitable conductive material. Cap 153 includes a substantially flat inner surface 155, a substantially flat outer surface 157 and a continuous, rounded side surface 159 that provides cap with a circular outer profile in transverse cross-section along its length.

As can be seen, cap 153 is dimensioned for fitted insertion within transverse bore 41 (i.e., with side surface 159 disposed in circumferential contact against the portion of main housing 19 that immediate defines bore 41). A narrow annular groove 161 is formed in side surface 159 proximate to outer surface 157. Although not shown herein, an O-ring or gasket could be deposited within annular groove 161 to create a watertight seal between cap 153 and main housing 19.

Preferably, a flattened region 163 is provided in the portion of outer surface 29 of main housing 19 that immediately defines transverse bore 41. Further, with cap 153 properly mounted within bore 41, flat outer surface 157 of cap 153 lies substantially flush with flattened region 163.

In the present embodiment, cap 153 engages with the portion of main housing 19 that immediate defines bore 41 through a press-fit relationship. However, it is to be understood that alternative means for securing cap 153 within bore 41, such through a threaded engagement, could be implemented without departing from the spirit of the present invention.

To assist in the process of removing cap 153 within bore 41, an externally accessible, inwardly protruding hole 165 is preferably provided into outer surface 157 of cap 153. In this manner, a self-threading screw (or other similar item) could be inserted into hole 165 to facilitate removing or extracting cap 153 from bore 41.

A metal crescent, or wave, spring 167 is disposed in direct contact between second terminal 149-2 of voltage suppression component 17 and flattened inner surface 155 of cap 153. During assembly of protector 11, crescent spring 167 applies continuous inward pressure onto voltage suppression component 17 that is sufficient so as to maintain first terminal 149-1 in conductive contact with enlarged flattened surface 85-1 on center pin 61. Additionally, crescent spring 167 compresses to the extent necessary so that cap 153 can be retained within bore 41. As such, it is to be understood, crescent spring 167 functions (i) to maintain voltage suppression component 17 in constant contact against center pin 61, (ii) to establish an electrical path between voltage suppression component 17 (which is, in turn, connected to inner conductor 15) and cover 153 (which is, in turn, connected to grounded outer conductor 13), and (iii) to accommodate for tolerance variation of parts and certain environmental conditions, including temperature changes, shock and/or vibration.

Accordingly, it is to be understood that potentially harmful transient voltages transmitted along inner conductor 15 are ideally suppressed by component 17 which is, in turn, connected to grounded outer conductor 13 via spring 167 and cap 153.

As referenced briefly above, the following dimensional considerations limit the degree of disturbance imparted by component 17 onto the RF transmission line while, at the same time, allow for the transmission of higher frequencies through a coaxial device 11 that is relatively compact in overall size, which are all principal objects of the present invention.

Specifically, as a first dimensional consideration, voltage suppression component 17 is constructed such that its length $L_2$ exceeds its width W. In particular, under optimal conditions, component 17 is constructed such that its length $L_2$ is in the range of approximately 1.5 to 2.5 times greater than the average of width W and height H.

Further, as a second dimensional consideration, the diameter $D_2$ of inner conductor 15 at its point of contact with voltage suppression component 17 is preferably equal to width W of voltage suppression component 17. In particular, under optimal conditions, contact portion 79 of center pin 61 is constructed such that its diameter $D_2$ is approximately 0.75 to 1.5 times the width W of component 17.

Lastly, as a third dimensional consideration, the inner diameter $D_1$ of main housing 19 in the region designed to receive contact portion 79 of center pin 61 (i.e., in the region immediately surrounding bore 41) is preferably 2.5 to 3.0 times the diameter $D_2$ of contact portion 79 when air is utilized as the dielectric within this region of interior cavity 23 between outer conductor 13 and inner conductor 15. By providing main housing 19 with a relatively enlarged inner diameter $D_1$ in the region of contact between center pin 61 and voltage suppression component 17, the transmission line impedance (approximately 50 ohms) is uniformly maintained (i.e., without experiencing transmission line disturbance in the region of contact between center pin 61 and voltage suppression component 17 or relying upon other compensation techniques), which is a principal object of the present invention.

It should be noted that if a solid dielectric material is utilized within cavity 23 in the region that immediately surrounds bore 41 (i.e., in place of air), the inner diameter $D_1$ within this region would need to be even larger than previously suggested to achieve a similar degree of optimized performance.

It is to be understood that the particular construction of protective device 11 is intended to be merely exemplary and those skilled in the art shall be able to make numerous variations and modifications to it without departing from the spirit of the present invention. All such variations and modifications are intended to be within the scope of the present invention as defined in the appended claims.

Figure 10:
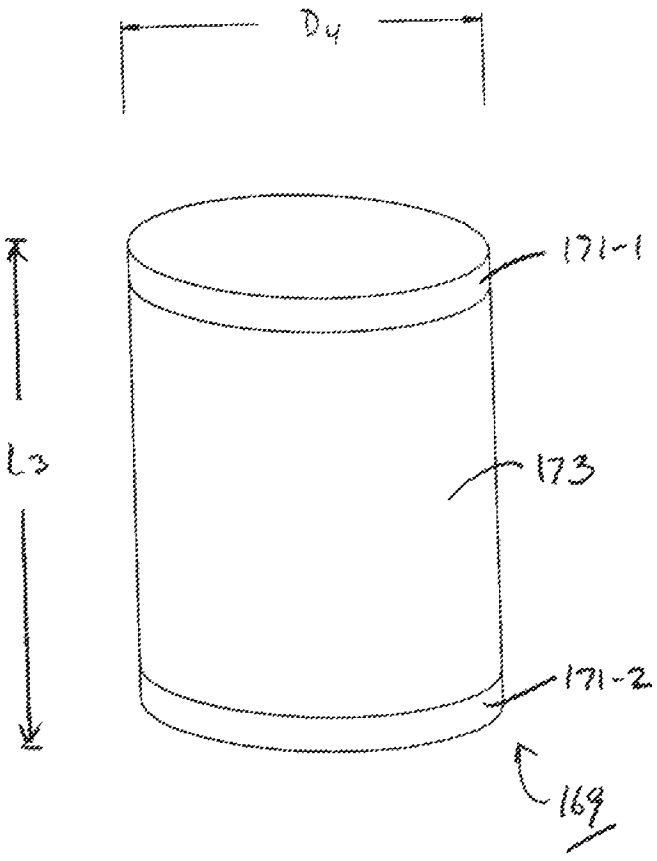
FIG. 10 is an enlarged, front perspective view of a modified version of the voltage suppression component shown in FIG. 9.

For instance, referring now to FIG. 10, there is shown a voltage suppression component 169 that could be used in protective device 11 in place of component 17. As can be seen, component 169 is similar to component 17 in that component includes first and second, flattened contact electrodes, or terminals, 171-1 and 171-2 separated by an elongated, central insulator 173 constructed preferably of a suitable dielectric material, such as a ceramic or glass material. Additionally, terminals 171 and insulator 173 together provide component 17 with a substantial overall length $L_3$ which is preferably equal to the length $L_2$ of component 17.

Voltage suppression component 169 differs from component 17 in that component 169 is uniformly circular in transverse cross-section along the entirety of its length. In order to provide component 169 with similar performance characteristics as component 17, component 169 preferably has a transverse cross-section diameter $D_4$ that is roughly equal to width W of component 17.

What is claimed is:

1. A protective device for transmitting electromagnetic signals of a desired frequency band, the protective device comprising:

(a) an outer conductor, (b) an inner conductor extending within the outer conductor, the inner and outer conductors being spaced apart and electrically insulated from one another, the inner conductor having a contact portion with a diameter, and (c) an electrical component comprising first and second opposing contact terminals, the first contact terminal directly contacting the contact portion of the inner conductor, the second contact terminal being conductively coupled to the outer conductor, (d) wherein the first contact terminal for the electrical component has a width that is approximately equal to the diameter of the contact portion of the inner conductor.

2. The protective device as claimed in claim 1 wherein the electrical component is a gas discharge tube.

3. The protective device as claimed in claim 1 wherein the electrical component has a uniform transverse cross-section along the entirety of its length.

4. The protective device as claimed in claim 3 wherein the electrical component is rectangular in transverse cross-section.

5. The protective device as claimed in claim 3 wherein the electrical component is circular in transverse cross-section.

6. The protective device as claimed in claim 1 wherein the inner conductor is shaped to include a flattened surface against which the first terminal of the electrical component is disposed in direct contact.

7. The protective device as claimed in claim 1 wherein the electrical component has an overall length extending between the first and second contact terminals that is greater than the width of the first contact terminal.

8. A protective device for transmitting electromagnetic signals of a desired frequency band, the protective device comprising:

(a) an outer conductor, and (b) an inner conductor extending within the outer conductor, the inner and outer conductors being spaced apart and electrically insulated from one another, the inner conductor comprising, (i) a first conductive pin having a first end and a second end, the second end of the first conducive pin including a tapered surface, (ii) a second conducive pin disposed in coaxial alignment with and the first conductive pin, the second conductive pin adapted for movement relative to the first conductive pin, the second conductive pin having a first end and a second end, the second end of the second conductive pin including a tapered surface, and (iii) a resilient conductive band disposed coaxially around the tapered surfaces of the first and second conductive pins and in direct contact therewith.

9. The protective device as claimed in claim 8 wherein the resilient conductive band is generally cylindrical in shape and is adapted for radial expansion.

10. The protective device as claimed in claim 9 wherein the resilient conductive band is shaped to include a longitudinal slit to allow for radial expansion.

11. The protective device as claimed in claim 8 wherein a longitudinal bore is formed into second end of the first conductive pin.

12. The protective device as claimed in claim 11 wherein the first end of the second conductive pin is dimensioned for axial insertion into and slidable displacement within the bore in the first conductive pin.

13. The protective device as claimed in claim 12 wherein the second pin is adapted for axial and radial displacement relative to the first pin.

14. The protective device as claimed in claim 8 wherein the tapered surface on the second conductive pin extends as a mirror image of the tapered surface on the first conductive pin.

15. The protective device as claimed in claim 8 wherein the second end of each of the first and second conductive pins is generally conical in shape.

16. The protective device as claimed in claim 8 further comprising an electrical component coaxially coupled to the second conductive pin.

17. The protective device as claimed in claim 16 wherein the electrical component includes first and second opposing terminals, the first terminal of the electrical component being disposed in direct conductive contact with the second end of the second conductive pin.

18. The protective device as claimed in claim 17 wherein the electrical component is a capacitor.

19. The combination of:

(a) a first conductive pin having a first end and a second end, the second end of the first conducive pin including a tapered surface, (b) a second conducive pin disposed in coaxial alignment with and the first conductive pin, the second conductive pin adapted for movement relative to the first conductive pin, the second conductive pin having a first end and a second end, the second end of the second conductive pin including a tapered surface, and (c) a resilient conductive band disposed coaxially around the tapered surfaces of the first and second conductive pins and in direct contact therewith.

20. The combination as claimed in claim 19 wherein the resilient conductive band is generally cylindrical in shape and adapted for radial expansion.

21. The combination as claimed in claim 20 wherein the resilient conductive band is shaped to include a longitudinal slit to allow for radial expansion.

22. The combination as claimed in claim 19 wherein a longitudinal bore is formed into second end of the first conductive pin, the longitudinal bore being dimensioned to axially receive the first end of the second conductive pin.

* * * * *